US005709204A

United States Patent [19]

Lester

[11] Patent Number: 5,709,204

[45] Date of Patent: Jan. 20, 1998

[54] AIRCRAFT PASSENGER OXYGEN, SURVIVAL AND ESCAPE MASK

[76] Inventor: Richard Lester, 4010 Rolinda St., Dallas, Tex. 75211

[21] Appl. No.: 740,735

[22] Filed: Nov. 4, 1996

[51] Int. Cl.[6] ..... A62B 7/14

[52] U.S. Cl. ..... 128/205.25; 128/204.18; 128/203.29; 128/207.12; 128/202.27

[58] Field of Search ..... 128/205.25, 208.28, 128/201.28, 202.11, 202.16, 203.29, 204.27, 201.25, 205.27, 206.28, 207.12, 206.15, 205, 13, 204.26, 204.18, 206.17, 202.27, 202.28, 202.29, 203.11

[56] References Cited

U.S. PATENT DOCUMENTS

| | | | |
|---|---|---|---|
| 374,831 | 12/1887 | Harrington | 128/203.29 |
| 2,344,718 | 3/1944 | Morehouse | 128/201.23 |
| 2,990,838 | 7/1961 | Cross | 128/207.12 |
| 3,521,627 | 7/1970 | Murry | 128/202.27 |
| 4,173,220 | 11/1979 | Ratz et al. | 128/201.28 |
| 4,494,538 | 1/1985 | Ansite | 128/202.27 |
| 4,506,665 | 3/1985 | Andrews et al. | 128/202.27 |
| 4,595,003 | 6/1986 | Shoemaker et al. | 128/201.25 |
| 4,796,615 | 1/1989 | Bullock et al. | 128/202.27 |
| 4,807,614 | 2/1989 | van der Smissen et al. | 128/201.28 |
| 5,348,001 | 9/1994 | Danon | 128/204.18 |
| 5,586,551 | 12/1996 | Hilliard | 128/203.29 |

*Primary Examiner*—Vincent Millin
*Assistant Examiner*—V. Srivastava
*Attorney, Agent, or Firm*—John E. Vandigriff

[57] ABSTRACT

The invention is a mask that can be used as an aircraft passenger oxygen mask, survival and escape mask. The mask includes a connector ring for connecting an oxygen supply. The oxygen connector is held connected to the mask by a pin, but can be removed with the pin in place by utilizing a break-away ring mounted in and held in place in the mask by an O-ring. Valves in the mask and connector allow a person to breath in oxygen and exhale while the oxygen supply is connected, and to continue to breath in through a filter and exhale through a valve after the oxygen supply has been removed.

16 Claims, 7 Drawing Sheets

AIRCRAFT PASSENGER OXYGEN, SURVIVAL AND ESCAPE MASK

FIELD OF THE INVENTION

The invention relates to oxygen masks used in aircraft and for emergency use, and more particularly to an oxygen mask that can be used for passenger oxygen in an aircraft, and for an emergency survival and escape mask.

BACKGROUND OF THE INVENTION

All passenger aircraft have an oxygen mask for each passenger. The mask is attached to an oxygen line that allows the mask to drop from a ceiling compartment to a position within reach of the passenger. If the mask is detached from the oxygen line, the mask is of no benefit to the passenger since the mask does not seal itself from the aircraft cabin atmosphere. In the event of an aircraft crash, the passenger is not protected from smoke that may be in the passenger cabin. The passenger cannot be removed with the mask in position over the passenger's face since it is attached to the oxygen line, and if disconnected from the oxygen line, smoke can be inhaled by the passenger. The mask is removed when the passenger is evacuated allowing the passenger to inhale any smoke or fumes present in the passenger cabin.

SUMMARY OF THE INVENTION

The invention is a mask that can be used as an aircraft passenger oxygen mask, survival and escape mask. The mask includes a connector ring for connecting an oxygen supply. The oxygen connector is held connected to the mask by a pin, but can be removed with the pin in place by utilizing a break-away ring mounted in and held in place in the mask by an O-ring. Valves in the mask and connector allow a person to breath in oxygen and exhale while the oxygen supply is connected and to continue to breath in through a filter and exhale through a valve after the oxygen supply has been removed.

DESCRIPTION OF A PREFERRED EMBODIMENT

Figure 1:
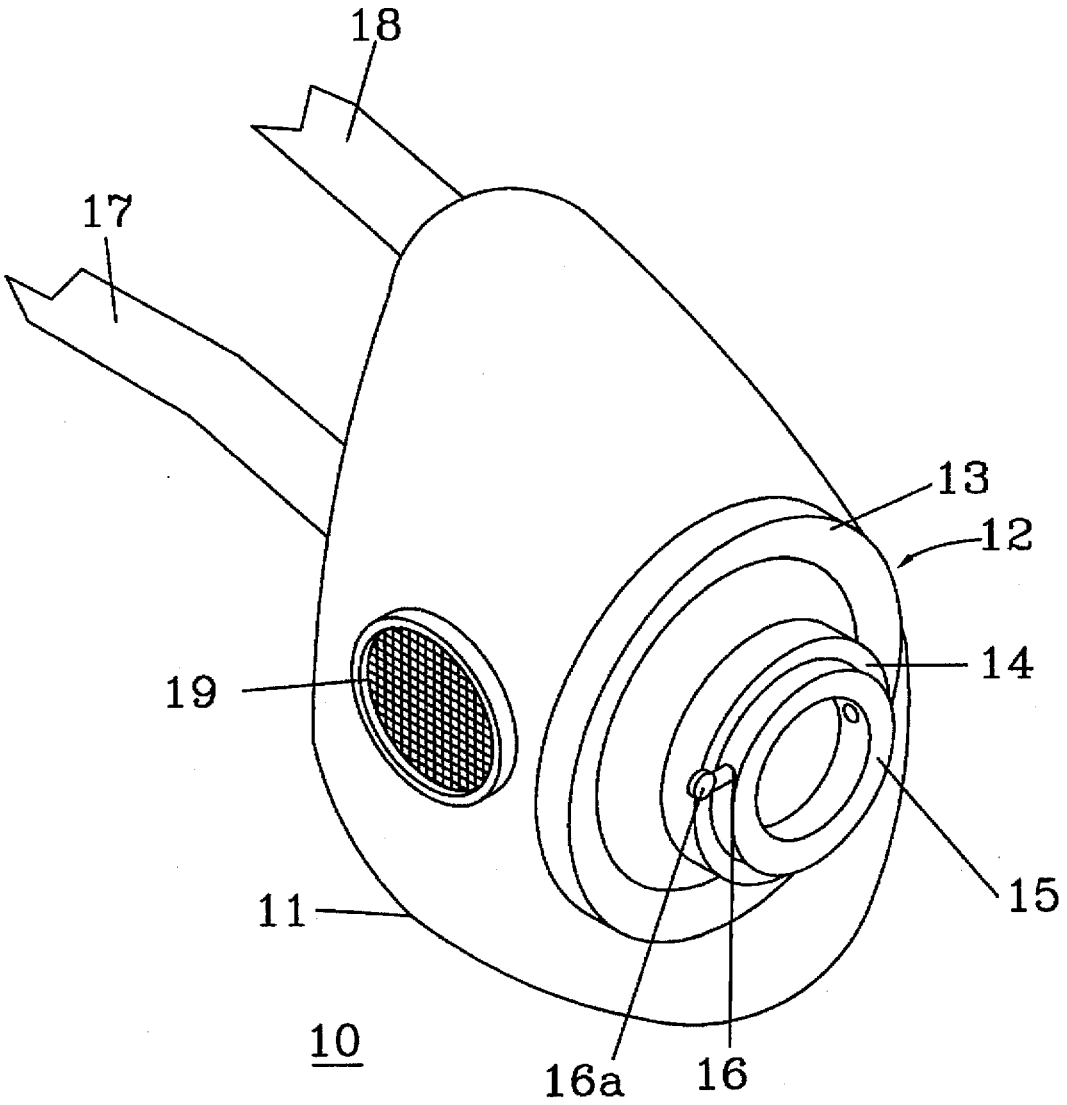
FIG. 1 is an isometric view of the mask of the present invention.

FIG. 1 is an isometric illustration of the oxygen mask 10 of the present invention. Mask 10 has a body 11 of a suitable material, such as rubber, plastic, or heath cloth, that can be placed over the nose and mouth of a person and seal against the atmosphere outside the mask. Mask 10 is held over the nose and mouth by straps 17 and 18. Mask 10 has a valve/connector part 12 that includes flange 13 and connector ring 14 with a break-away ring 15. Opening 16 is for inserting a pin 16*a* to hold oxygen line connector (shown in FIG. 2) in connector ring 14. Filter 19 allows breathing with the mask on when it is not connected to an oxygen line. Filter 19, there is one on each side of mask 10, filters out smoke and other toxic vapors.

Figure 2:
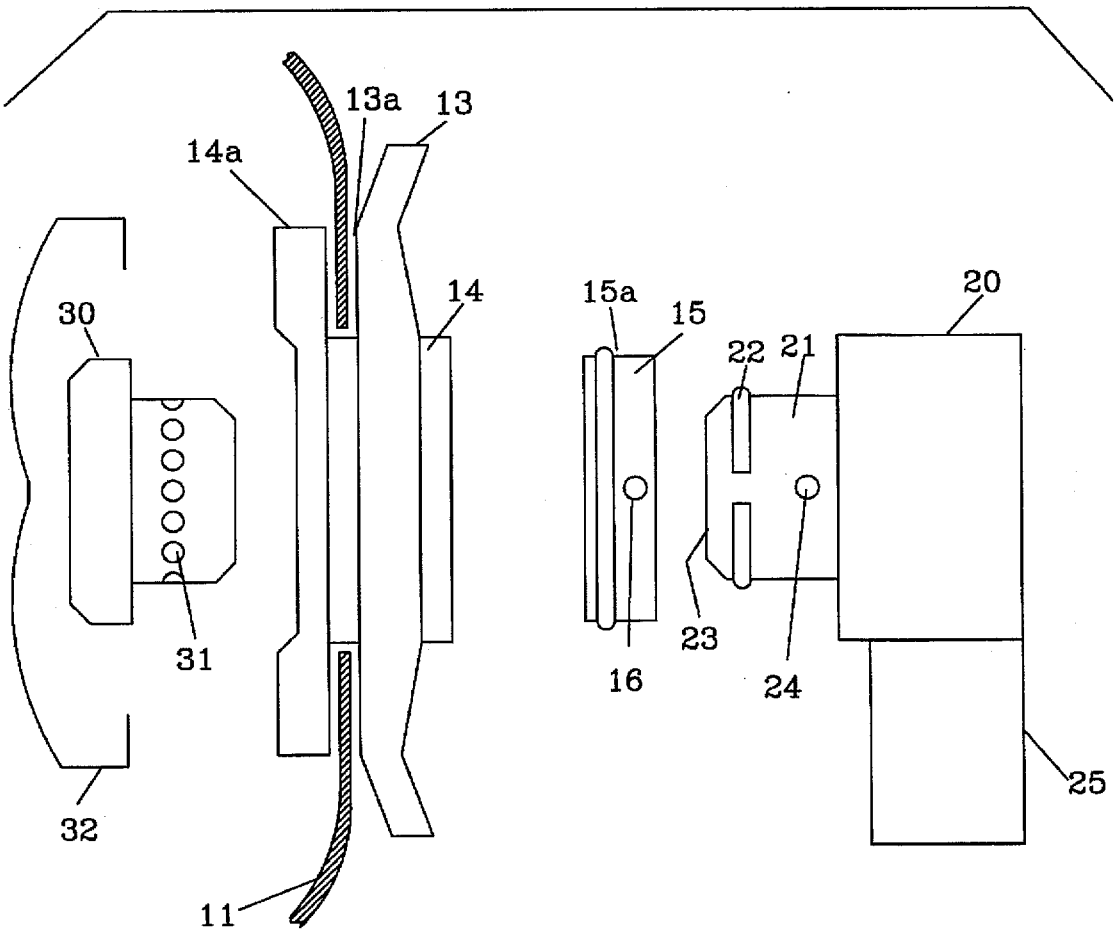
FIG. 2 is an exploded side view of the oxygen mask of FIG. 1.

FIG. 2 is an exploded side view showing the various parts of mask 10. Connector ring 14 is mounted in mask body 11 with mask body 11 in channel 13*a* in an air-tight fitting. Connector ring 14, on the outside of the mask, includes flange 13 and an inside ring 14*a*. Inside the mask, valve housing 30 is inserted into inside ring 14*a* and held in place with spring clip 32. Break-away ring 15, with O-ring 15*a*, is placed inside connector 14 and held there by O-ring 15*a*. Oxygen connector 20 has a nipple 21 that is inserted into break-away ring after it is placed in connector 14, and held in place by a pin inserted through opening 16 in connector 14 and opening 24 in nipple 21. Compression ring 22 seals the connection between nipple 21 and the inside of connector ring 14.

Figure 3:
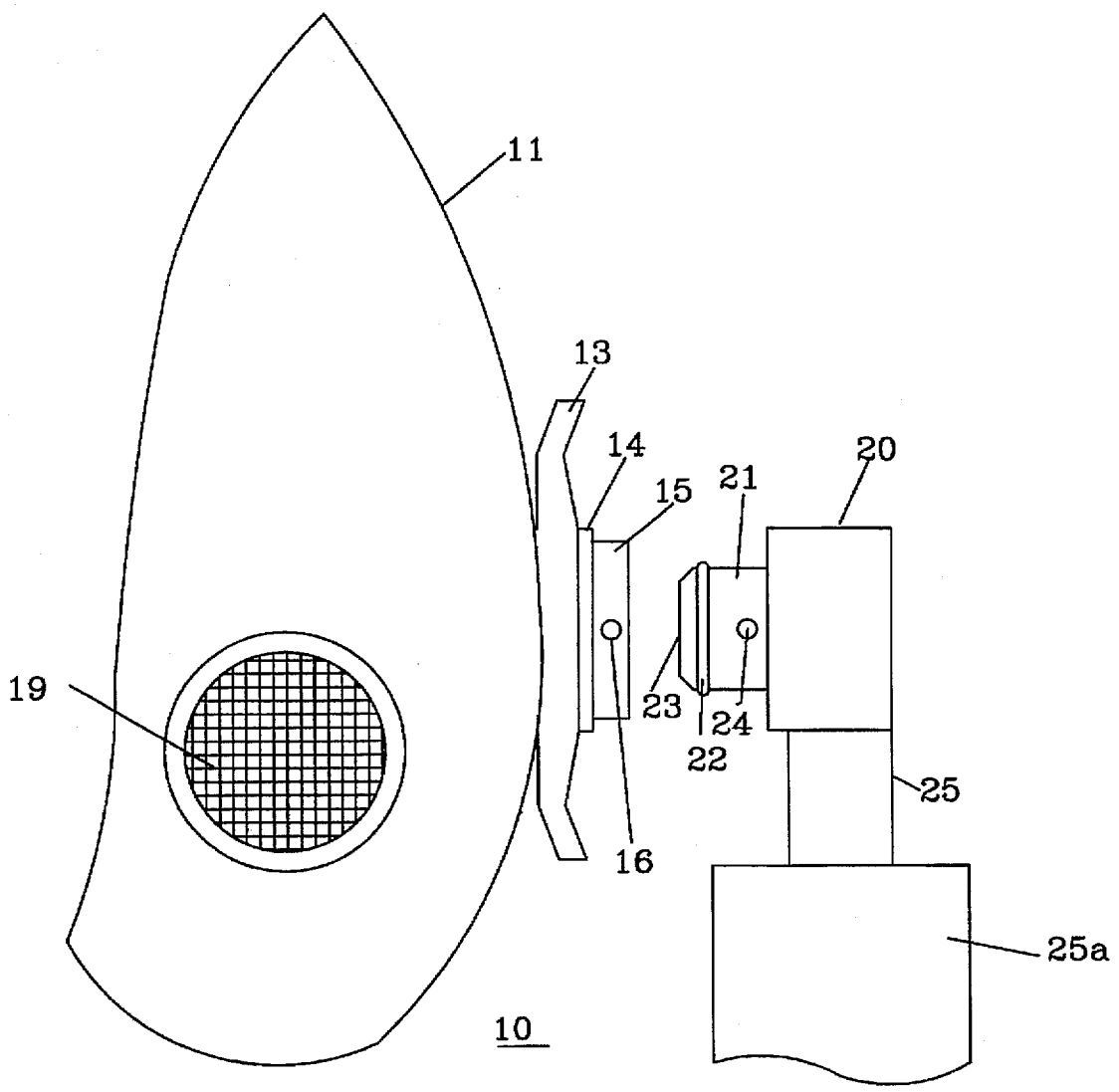
FIG. 3 is a side view showing the mask and the oxygen line detached from the mask.

FIG. 3 is a side view of mask 10 showing connecter ring 14 and flange 13 mounted on mask 10. An oxygen line connector 20 is positioned in front of mask 10 as it would be positioned before connecting to mask 10 via connector ring 14. Connector 20 includes nipple 21 having end 23, that is inserted into ring 14. Compression ring 22 on nipple 21 provides a seal when connector 20 is secured in connector ring 14. Opening 24 aligns with opening 16 in connector ring 14 so that a latch pin can be inserted though openings 24 and 16 to hold connector 20 inside connector ring 14. Connector 20 is connected to an oxygen line via end 25 and oxygen breather bag 25*a*.

Figure 4:
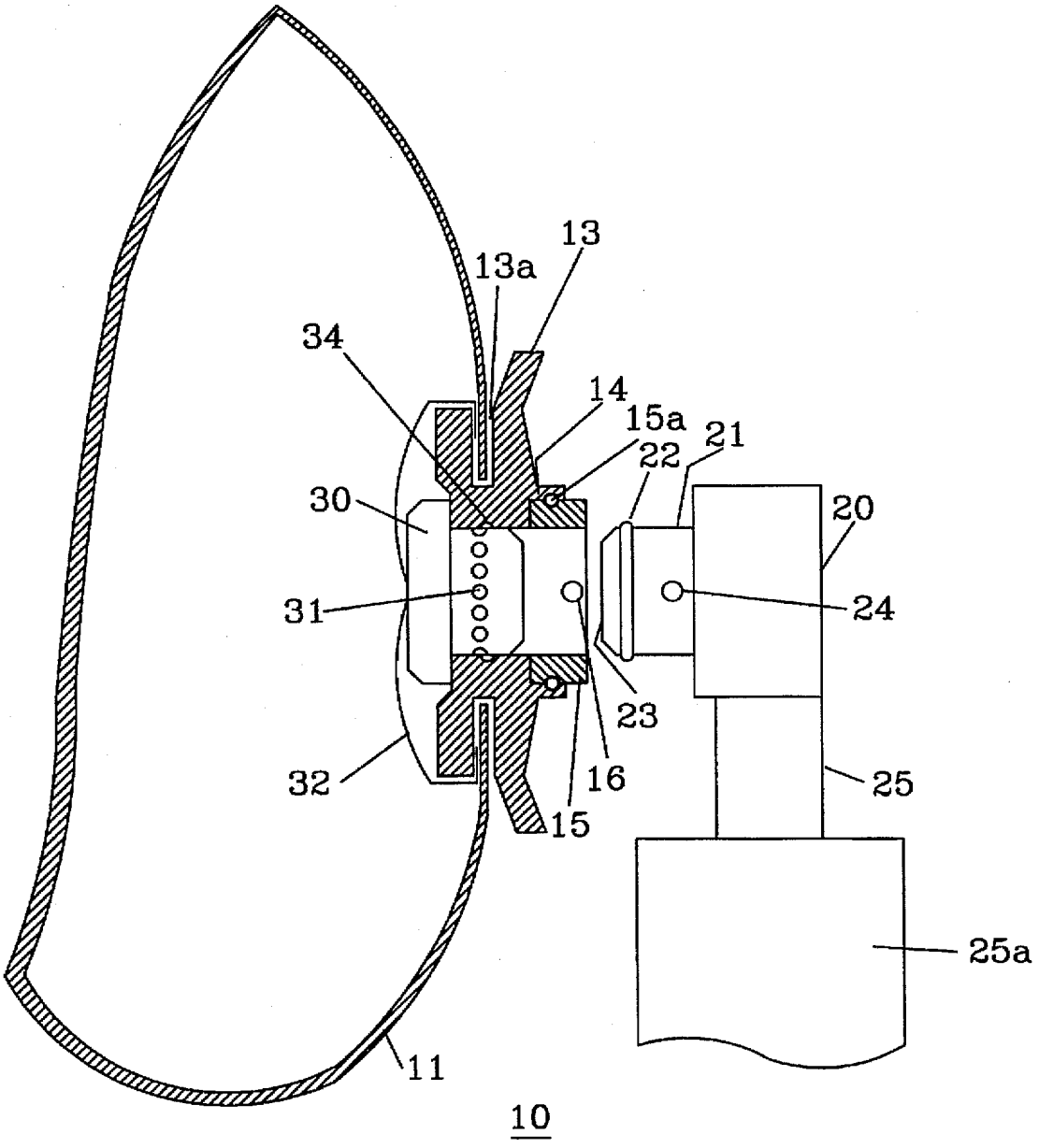
FIG. 4 shows a cross-sectional view of the mask with the oxygen line detached.

FIG. 4 is a side view of mask 10 in cross-section. Flange 13 has a channel 13*a* into which mask body 11 is sealed. Connector ring 14, with break-away ring 15, is shown held in place by O-ring 15*a*. Valve 30, with air passages 31, is held in connector ring 14 by leaf spring clip 32. Valve 30 is slidably mounted in connector ring 14, and is moved outward from ring 14 when oxygen is connected to mask 10, as described below, when connector 20 is inserted into ring 15. Reconnect channel is shown at 34, and is explained with reference to FIG. 7.

Figure 5:
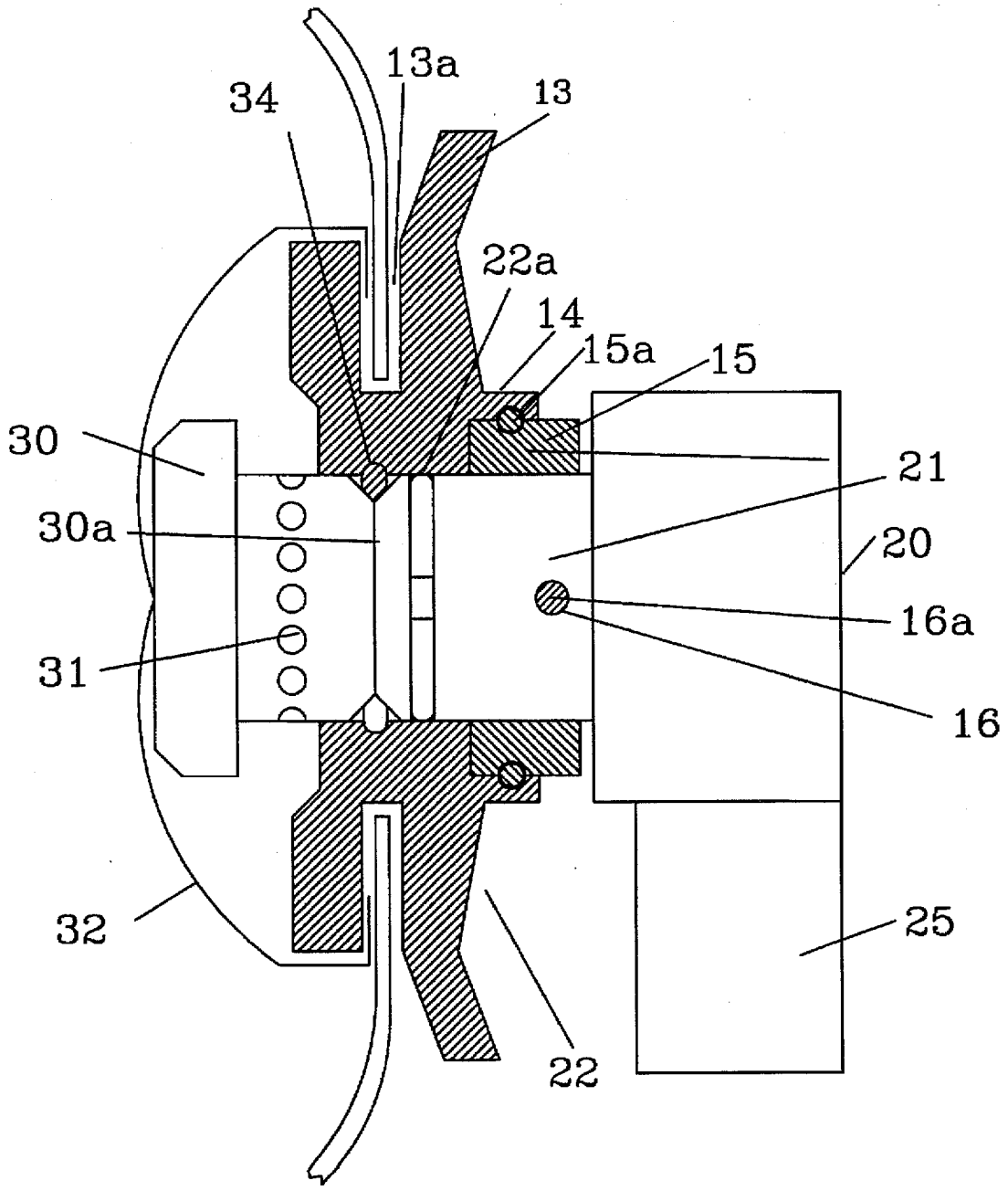
FIG. 5 is a partial view of the mask in cross-section showing the oxygen line attached.

FIG. 5 is a partial view, in cross-section, of mask 10 showing oxygen connector 20 inserted into connector ring 14. When oxygen connector 20 is inserted into connector ring 14, and break-away ring 15, end 23 of nipple 21 pushes against valve 30, moving it out of ring 14. When nipple 21 is fully seated in ring 14, compression ring 22 seals against the inner wall at 22*a*, and a pin 16*a* is inserted into opening 16 holding nipple 21 and oxygen connector 20 in place. When nipple 21 is fully seated in ring valve 30 is moved out of ring 14 so that oxygen flowing through nipple 21 and valve 30 exits through openings 31 into mask 10. When nipple 21 and oxygen connector 20 are removed from ring 14, spring 32 forces valve 30 into ring 14 sealing the inside of mask 10 from the outside air.

Figure 6:
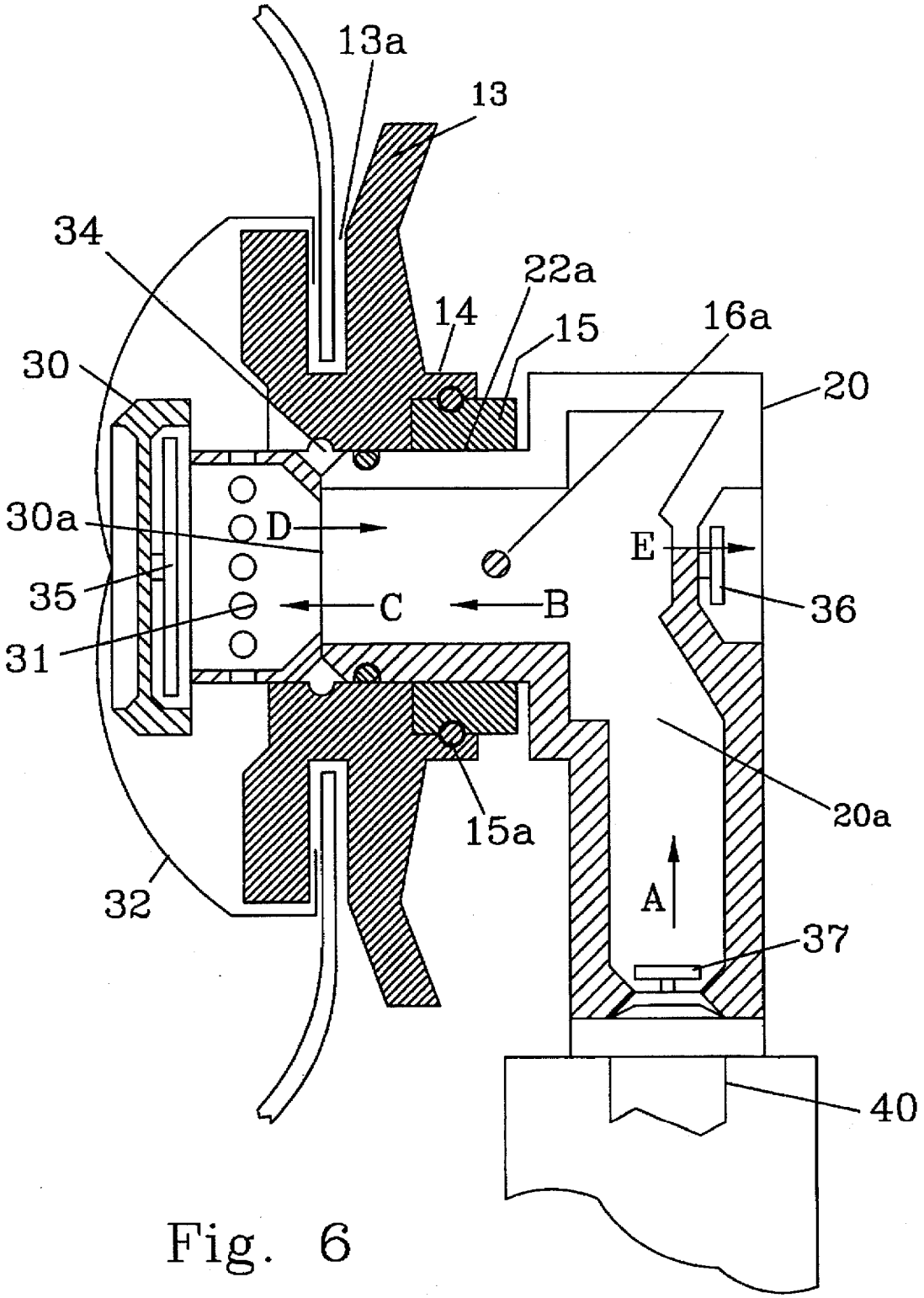
FIG. 6 is a partial view of the mask showing both the mask and oxygen line in cross-section.

FIG. 6 is a cross-sectional view showing oxygen connector 20 connected to mask 10. Oxygen flows, as indicated by the arrows A, B and C, through oxygen connector 20. When the person wearing mask 10 exhales, one-way valves 35 and 36 open, allowing the exhaled breath to be expelled from the mask 10 as shown by arrows D and E.

Valve 37, in connector 20, is a one-way valve allowing oxygen to flow into connector 20 through channel 20*a*, but does not allow exhaled breath to flow back through oxygen line 40 and oxygen rebreather bag 25*a*.

In the event of an emergency, retainer pin 16*a* in opening 16 is removed and connector 20 is disengaged from mask 10. If, for any reason, the pin in opening 16 cannot be removed, then connector 20 can be removed by grasping flange 13 and pulling on connector 20. Ring 15, which is held in by O-ring 15*a*, will pull out of ring 14 allowing connector 20 to be removed from connector ring 14.

With oxygen removed from the mask, the wearer can continue to breath in filtered air though filter 19 (FIG. 1)and exhale though valve 35. For example, in the event of an airplane crash, the wearer can continue to wear the mask after it has been disconnected from the oxygen line and not breath in smoke and other toxic fumes produced by the crash aircraft. This prevents death or other problems from smoke and toxic fume inhalation prior to moving the person from the crashed aircraft.

Figure 7:
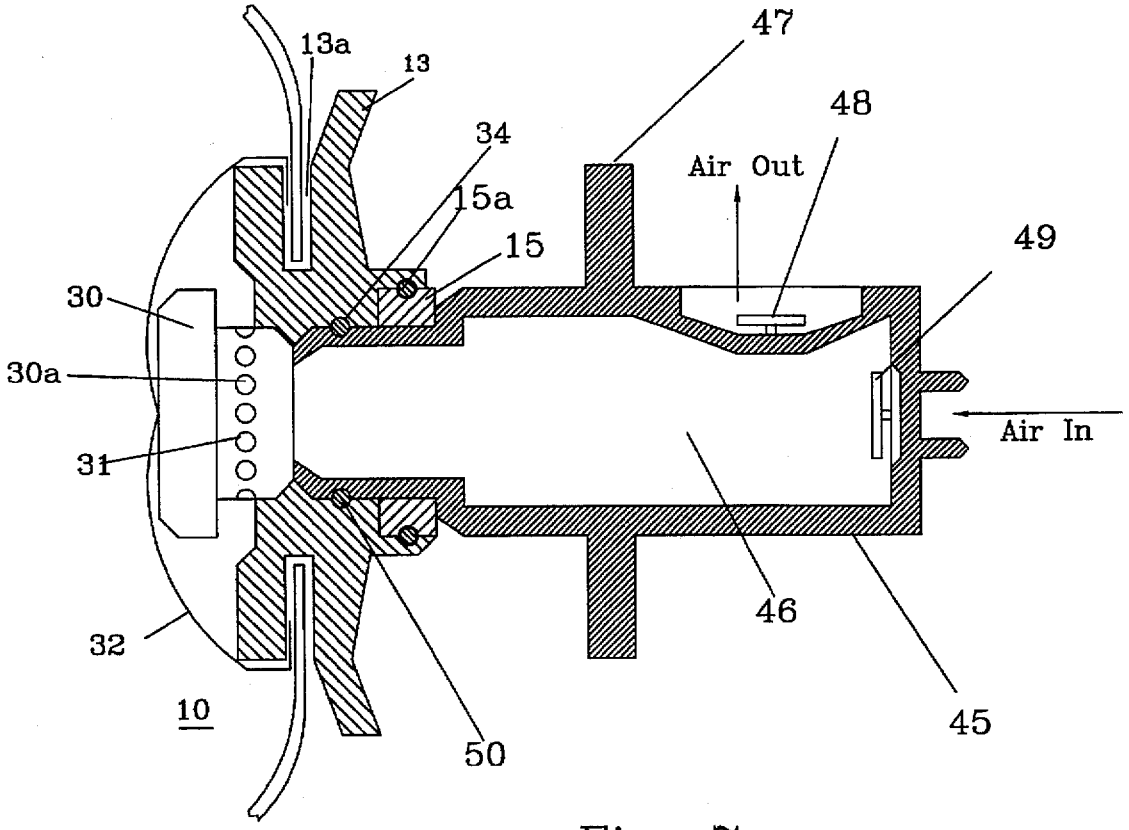
FIG. 7 shows the mask connected to an emergency oxygen supply.

FIG. 7 shows mask 10 connected to an emergency oxygen source by connector 45. Connector 45 has an O-ring seal 50 which secures connector 45 in reconnector channel 34. Connector 45 may be attached to portable oxygen bottles carried by emergency medical personal that would be in attendance at an aircraft crash. Connector 45 has a flange 47 used to move connector 45 into mask 10. Connector 45 has an air inlet valve 49 through which air or oxygen is introduced into connector 45 as shown by the arrow labeled "Air In". Exhaled breath is exhausted though valve 48 which indicates "Air Out". Air flows through chamber 46 into and out of mask 10 and connect 45. When connector 45 is inserted into mask 10, valve 30 is moved exposing openings 30*a* allowing air to flow into and out of mask 10.

What is claimed:

1. A multi-purpose oxygen mask, comprising:

a connector ring;

a mask body for covering the nose and a part of the face sealed to said connector ring;

a movable valve in said connector ring for allowing oxygen into the mask;

a connector insertable into the connector ring for connecting oxygen to the mask, said connector moving said movable valve into a position to admit oxygen into the mask when the connector is inserted into the connector ring;

a pin and openings for said pin to secure the connector to said connector ring; and a break-away ring in said connector ring to allow removing the connector from the connector ring while said pin is in place.

2. The mask according to claim 1, including at least one valve for admitting oxygen into the connector, and at least one valve for passing exhaled breath from the connector.

3. The mask according to claim 1, wherein said break-away ring is held in said connector by an O-ring.

4. The mask according to claim 1, including a flange on the connector ring to grasp when attaching and disconnecting the connector.

5. The mask according to claim 1, wherein the movable valve has a plurality of holes therein through which oxygen flows into the mask.

6. The mask according to claim 1, including a spring clip for holding said movable valve in a closed position when the mask is not connected to an oxygen supply.

7. The mask according to claim 1, wherein said movable valve includes an exhalation valve.

8. The mask according to claim 1 wherein said mask includes a filtered air inlet to permit breathing when the mask is disconnected from an oxygen supply.

9. A multi-purpose oxygen mask, comprising:

a connector ring having first and second flanges;

a mask body for covering the nose and a part of the face sealed between said first and second flanges;

a circular movable valve in said connector ring for allowing oxygen into the mask;

a spring clip for holding said movable valve in said connector ring and in a closed position within said connector ring;

a connector insertable into the connector ring for connecting oxygen to the mask, said connector moving said movable valve into a position to admit oxygen into the mask when the connector is inserted into the connector ring;

a pin and openings for said pin to secure the connector to said connector ring; and a break-away ring in said connector ring to allow removing the connector from the connector ring while said pin is in place.

10. The mask according to claim 9, including at least one valve for admitting oxygen into the connector, and at least one valve for passing exhaled breath from the connector.

11. The mask according to claim 9, wherein said break-away ring is held in said connector by an O-ring.

12. The mask according to claim 9, including a flange on the connector ring to grasp when attaching and disconnecting the connector.

13. The mask according to claim 9, wherein the circular movable valve has a plurality of holes around the periphery of the valve through which oxygen flows into the mask.

14. The mask according to claim 9, including a spring clip for holding said movable valve in a closed position when the mask is not connected to an oxygen supply.

15. The mask according to claim 9, wherein said movable valve includes a second exhalation valve.

16. The mask according to claim 9 wherein said mask includes at least one filtered air inlet in addition to the circular movable valve to permit breathing when the mask is disconnected from an oxygen supply.

* * * * *